US006223473B1

(12) United States Patent
Romig

(10) Patent No.: US 6,223,473 B1
(45) Date of Patent: May 1, 2001

(54) EXPLOSION RELIEF SYSTEM INCLUDING AN EXPLOSION RELIEF PANEL AND A BLAST SHAFT HAVING TWO OPENINGS

(75) Inventor: Frederick W. Romig, Wexford, PA (US)

(73) Assignee: CID Associates, Inc., Sarver, PA (US)

( * ) Notice: Subject to any disclaimer, the term of this patent is extended or adjusted under 35 U.S.C. 154(b) by 0 days.

(21) Appl. No.: 09/393,603

(22) Filed: Sep. 10, 1999

(51) Int. Cl.[7] ..... E04H 9/00
(52) U.S. Cl. ..... 52/1; 52/302.1
(58) Field of Search ..... 52/1, 302.1; 454/194, 454/353, 41; 49/68

(56) References Cited

U.S. PATENT DOCUMENTS

| | | | | |
|---|---|---|---|---|
| 3,000,293 | * | 9/1961 | Grace | 454/352 |
| 3,111,078 | * | 11/1963 | Breckenridge | 454/194 |
| 3,120,798 | * | 2/1964 | Nash | 454/350 |
| 3,173,356 | * | 3/1965 | Schierse et al. | 454/194 |
| 3,230,859 | * | 1/1966 | O'hea et al. | 454/357 |
| 3,242,844 | * | 3/1966 | Smith | 454/194 |
| 4,022,117 | * | 5/1977 | Mallian | 454/359 |
| 4,067,154 | * | 1/1978 | Fike | 52/99 |
| 4,276,725 | * | 7/1981 | Ash | 52/167.9 |
| 4,390,152 | * | 6/1983 | Jorgensen | 244/118.5 |
| 5,080,005 | * | 1/1992 | Kolt | 454/359 |
| 5,361,549 | * | 11/1994 | Betts | 52/1 |
| 5,417,014 | * | 5/1995 | Vincent et al. | 52/1 |
| 5,461,831 | * | 10/1995 | Michal | 52/1 |
| 5,605,185 | * | 2/1997 | McKeon | 160/1 |
| 5,722,181 | * | 3/1998 | Meyer | 34/235 |
| 5,749,178 | * | 5/1998 | Garmong | 52/79.1 |

* cited by examiner

*Primary Examiner*—Daniel P. Stodola
*Assistant Examiner*—Gregory J. Strimbu
(74) *Attorney, Agent, or Firm*—David V. Radack; William F. Lang, IV; Eckert Seamans Cherin & Mellott, LLC

(57) ABSTRACT

An explosion relief system for a building having a wall includes an explosion relief panel substantially covering an opening in the wall and a blast shaft mounted adjacent to the explosion relief panel. The blast shaft includes a first opening and a second opening. The first opening is adapted to permit at least a portion of a force of an explosion to escape therefrom and the second opening allows rain, snow and the like to pass through the blast shaft when the explosion relief panel substantially covers the opening in the wall. The second opening is substantially covered when the explosion relief panel is forced away from the opening in the wall when the explosion occurs. A blast shaft substantially as described above and a building including the explosion relief system described above are also provided.

20 Claims, 4 Drawing Sheets

EXPLOSION RELIEF SYSTEM INCLUDING AN EXPLOSION RELIEF PANEL AND A BLAST SHAFT HAVING TWO OPENINGS

BACKGROUND OF THE INVENTION

This invention relates to an explosion relief system for a building.

Explosion relief systems for buildings are provided in order to ameliorate the effects of an explosion inside a building. Typically, these systems include an explosion relief panel which will break away and thus provide a "weak" point in the building to relieve the force of the explosion in such a way to limit the damage. For buildings which are inside of other buildings, a blast shaft is associated with the explosion relief panel, the blast shaft directing the force of the explosion away from the inner building and then through the wall or the roof of the outer building.

For stand-alone buildings, there remains a need to direct the force of the explosion (and, concurrently, pieces of material which can act as shrapnel) out of the building to cause the least amount of damage. This need is particularly acute where human beings are in the vicinity of the building.

What is needed, therefore, is an explosion relief system that directs the force of the explosion as well as any "shrapnel" created thereby away from the building and any persons near the building, so that the least amount of damage is caused thereby.

SUMMARY OF THE INVENTION

The explosion relief system of the invention has met the above-mentioned needs as well as others. The explosion relief system for a building having a wall includes an explosion relief panel substantially covering an opening in the wall and a blast shaft mounted adjacent to the explosion relief panel. The blast shaft includes a first opening and a second opening. The first opening is adapted to permit at least a portion of a force of the explosion to escape therefrom and the second opening allows rain, snow and the like to pass through the blast shaft when the explosion relief panel substantially covers the opening in the wall. The second opening is substantially covered when the explosion relief panel is forced away from the opening in the wall when the explosion occurs.

A blast shaft substantially as described above and a building including the explosion relief system described above are also provided.

BRIEF DESCRIPTION OF THE DRAWINGS

A full understanding of the invention can be gained from the following detailed description of the invention when read in conjunction with the accompanying drawings in which.

DETAILED DESCRIPTION

Figure 1:
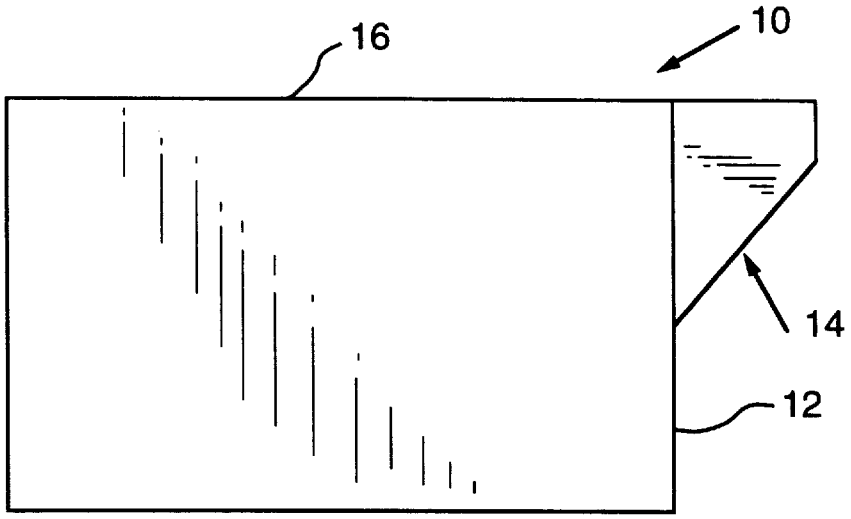
FIG. 1 is an elevational view of a building including an embodiment of the explosion relief system of the invention.
Figure 2:
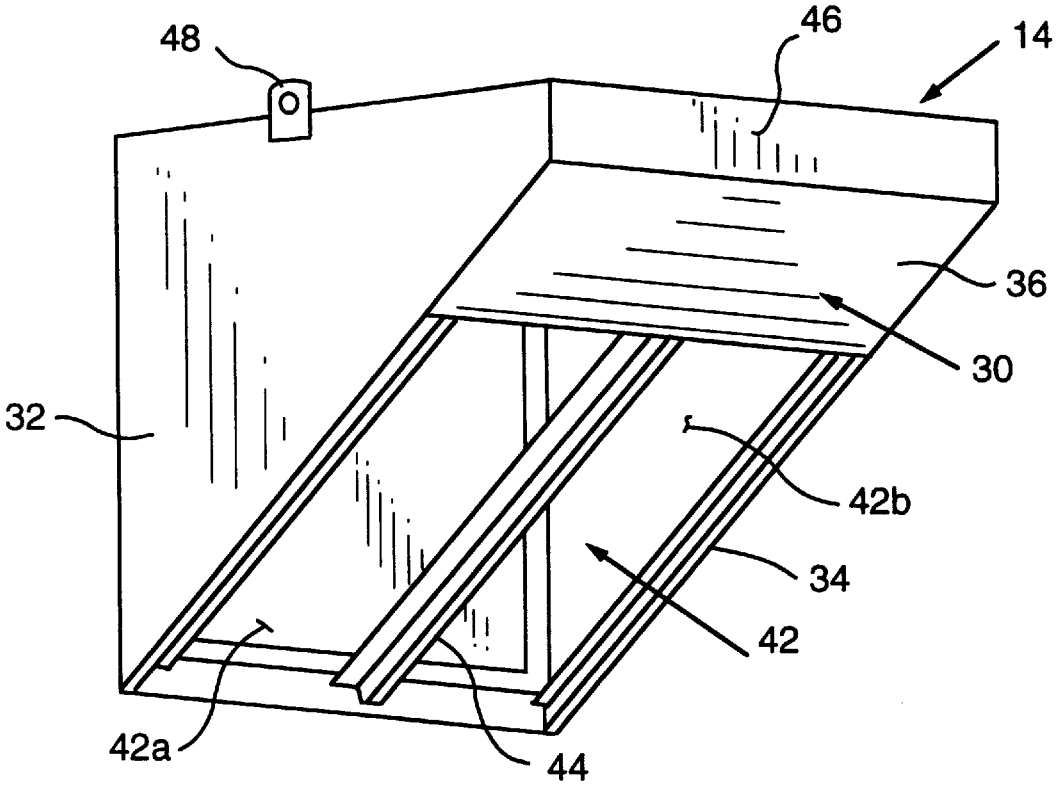
FIG. 2 is a perspective view of the explosion relief system only shown in FIG. 1.

Referring to FIG. 1, a building 10 is shown. The building includes a sidewall 12 in which the explosion relief system 14 of the invention is included. The building 10 also includes a roof 16. The building can be any stand-alone building, however, the explosion relief system 14 of the invention is particularly suited for use with hazardous storage buildings, such as those made by the Haz-Safe Division of CID Associates, Inc. of Sarver, Pa., the assignee of this invention. These hazardous storage buildings store hazardous materials which can explode and cause damage and/or fires. The explosion relief system 14 of the invention is one method of reducing the damage both to people and property of an explosion in a hazardous storage building.

Figure 3:
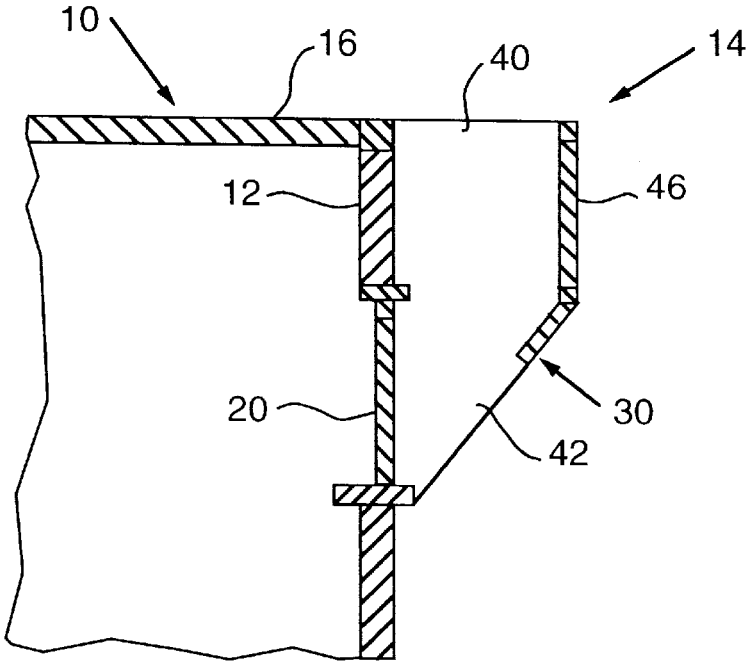
FIG. 3 is a cross-sectional view of the explosion relief system shown in FIG. 2.
Figure 4:
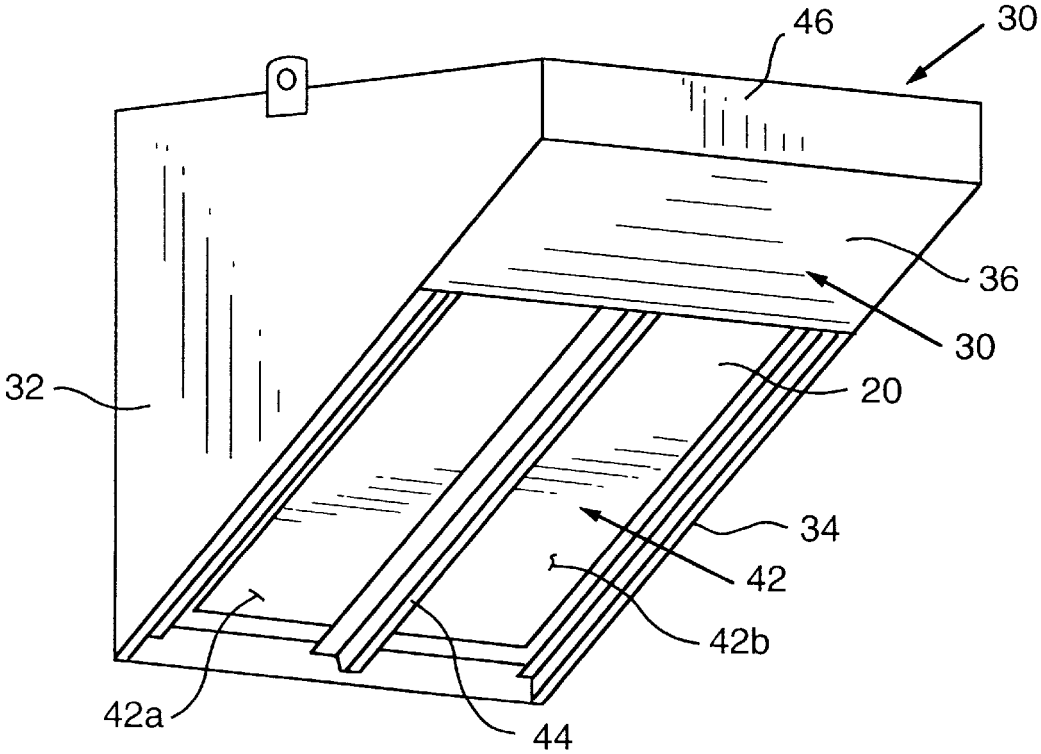
FIG. 4 is a perspective view of the explosion relief system when an explosion occurs.
Figure 5:
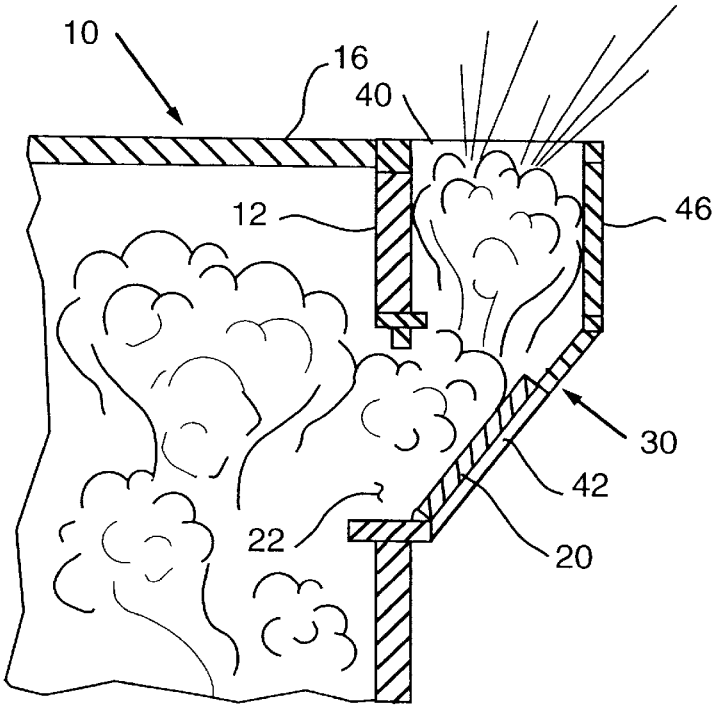
FIG. 5 is a cross-sectional view of the explosion relief system in the position shown in FIG. 4.

Referring now to FIGS. 2–5, the explosion relief system 14 of the invention will be described in detail. A bottom hinged explosion relief panel 20 is provided that substantially covers an opening 22 (FIG. 5) in the sidewall 12 of the building 10. It will be appreciated that the explosion relief system 14 can be located at any point on the building sidewall 12, although it is preferred to locate the explosion relief system 14 near the top of the building 10 as shown in FIG. 1. The explosion relief system 14 further includes a blast shaft 30 mounted adjacent to the explosion relief panel 20 on the outside of the building 10. The blast shaft 30 can be made of any desired material (as long as it meets the same blast ratings as the building), such as steel, and should be large enough to completely cover the opening 22. The blast shaft 30 includes a pair of opposed vertical plates 32 and 34 and an angled flange 36 (FIGS. 2 and 4) which connects the vertical plates 32, 34 to form the blast shaft 30. As can be seen in FIGS. 3 and 5, a first upper opening 40 (FIGS. 3 and 5) is defined by the blast shaft 30. A second opening 42 (FIGS. 2 and 4), which includes a cross-member 44 to divide it into two separate opening areas 42*a* and 42*b*, is defined by the blunt shaft 30. A substantially vertical plate member 46 is also provided for the blast shaft 30. A crane lifting lug 48 can also be provided for removal of a blast shaft during shipping of the building.

In accordance with the invention, the explosion relief panel 20 is bottom hingedly mounted to the sidewall 12. In this way, the explosion relief panel 20 can move from a first position, wherein the explosion relief panel 20 substantially covers the opening 22 in the sidewall (see FIGS. 2 and 3) to a second position wherein the explosion relief panel 20 is pivoted outwardly and away from the sidewall 12 and substantially covers both areas 42*a* and 42*b* of the second opening 42 (see FIGS. 4 and 5). As shown in FIG. 5, when the explosion relief panel 20 is pivoted away from the opening 22 and covers the second opening 42, at least a portion of the force of an explosion inside the building (shown graphically in FIG. 5) escapes through the opening 22, through the blast shaft 30 and out of the first opening 40 to the outside of the building 10. In this way, the force of the explosion and any shrapnel created thereby will be directed outwardly and upwardly away from the building. This direction is most likely the safest way to direct the explosion as it is the direction least likely to cause injury to property or people.

The explosion relief panel 20 is substantially only pivoted away from the sidewall 12 when forced into that position by an. explosion. Most all other times, the explosion relief panel 20 will be in the first position shown in FIGS. 2 and 3. It is at those times that the second opening 42 will provide a way for snow, rain and the like to pass through the blast shaft 30 and not accumulate therein.

Although a bottom hinged explosion relief panel 20 is shown and preferred, the invention is not limited to this arrangement for allowing movement of the explosion relief panel 20 from the first position to the second position in the event of an explosion. In fact, an explosion relief panel can be designed to become completely unattached from the sidewall 12 and then cover the second opening when an explosion occurs, although that arrangement is not particularly preferred due to the need to reattach the explosion relief panel 20 every time an explosion occurs.

Figure 6:
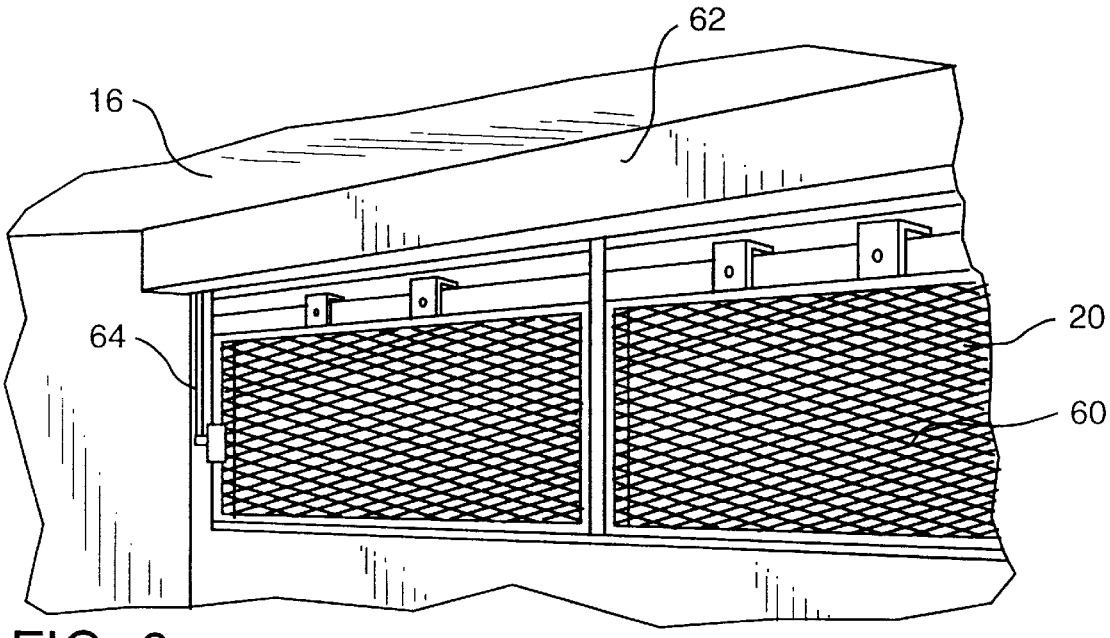
FIG. 6 is a perspective view of another embodiment of the explosion relief system of the invention as seen from the inside of the building.
Figure 7:
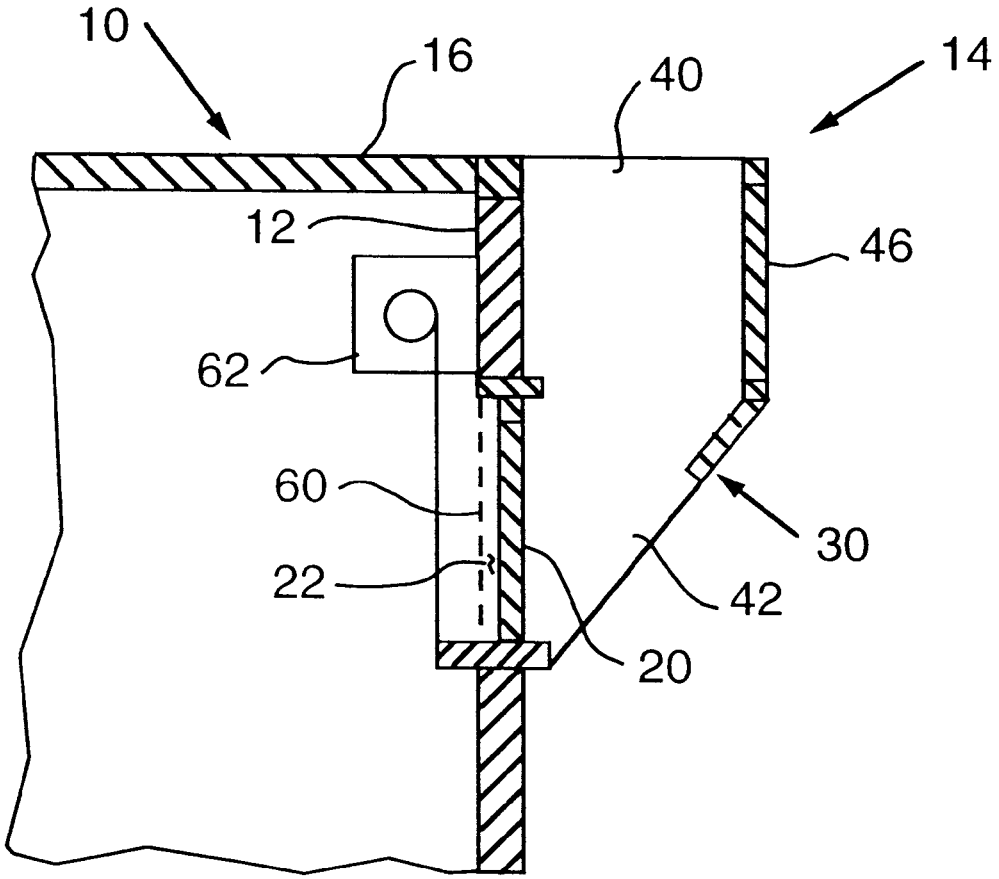
FIG. 7 is a cross-sectional view of the explosion relief system shown in FIG. 7, only showing the drop down shutter in the down position.

FIGS. 6–7 show another embodiment of the invention that operates under the same principles as the embodiment shown in FIGS. 1–5 only with some added features to enhance the basic explosion relief system 14 described above. Similar reference characters in FIGS. 6 and 7 to those in FIGS. 1–5 indicate similar structure. In order to avoid large pieces of shrapnel from exiting through the opening 22 and also to resist intruder entry into the building, a screen 60 can be provided. In addition, a drop down shutter 62 can also be provided which when once the explosion is completed, covers the opening to prevent any fire from escaping through the opening 22. In addition a security alarm system 64 (see FIG. 6) can be provided to prevent unauthorized entry of persons through the explosion relief panel 20. All of the aforementioned features (screen 60, drop down shutter 62 and security alarm 64) are known structures and features in the art It will be appreciated that an explosion relief system for a building has been described and illustrated. The explosion relief system is particularly suited for use with hazardous storage buildings and provides an efficient and safe way to ameliorate the potential for property and personal injury due to an explosion inside the building.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. An explosion relief system for a building including a wall having an opening, said system comprising:

an explosion relief panel for substantially covering the opening in said wall; and a blast shaft mounted adjacent to said explosion relief panel, said blast shaft including a first opening and a second opening, said first opening adapted to permit at least a portion of a force of an explosion to escape therefrom and said first and second openings allowing rain and snow to pass through said blast shaft when said explosion relief panel is in a first position in which said explosion relief panel is adapted to substantially cover said opening in said wall, said second opening being substantially covered when said explosion relief panel is moved into a second position, said explosion relief panel is adapted to be moved away from said opening in said wall into said second position when said explosion occurs.

2. The system of claim 1, wherein said explosion relief panel is adapted to be hingedly secured to said wall.

3. The system of claim 2, wherein said second opening is formed in a flange that is adapted to be angularly disposed from said wall.

4. The system of claim 1, including a screen for covering said wall opening to resist intruder entry and to resist objects from being propelled out of said wall opening when said explosion occurs.

5. The system of claim 1, including a drop down shutter that is adapted to cover said wall opening during a fire inside said building.

6. The system of claim 1, including a security alarm system.

7. An explosion relief system for a building including a wall having an opening, said system comprising:

an explosion relief panel for substantially covering the opening in said wall;

a blast shaft mounted adjacent to said explosion relief panel. said blast shaft including a first opening and a second opening, said first opening adapted to permit at least a portion of a force of an explosion to escape therefrom and said first and second openings allowing rain and snow to pass through said blast shaft when said explosion relief panel is in a first position is whichsaid explosion releif panel is adapted to substantially cover said is in a first position in which said explosion relief panel is adapted to opening in said wall said second opening being substantially covered when said explosion relief panel is moved into a second position, said explosion relief panel is adapted to be moved away from said opening in said wall into said second position when said explosion occurs and said first opening is disposed at a top of said blast shaft.

8. A blast shaft operatively associated with an explosion relief panel for covering an opening in a wall of a building, said blast shaft including a first opening and a second opening, said first opening adapted to permit at least a portion of a force of an explosion to escape therefrom and said first and second openings allowing rain and snow to pass through said blast shaft when said explosion relief panel is in a first position in which said explosion relief panel is adapted to substantially cover said opening in said wall, said second opening being substantially covered when said explosion relief panel is moved into a second position, said explosion relief panel is adapted to be forced away from said opening in said wall into said second position when said explosion occurs.

9. The blast shaft of claim 8, wherein said blast shaft is made of steel.

10. A blast shaft operatively associated with an explosion relief panel for covering an opening in a wall of a building, said blast shaft including a first opening and a second opening, said first opening adapted to permit at least a portion of a force of an explosion to escape therefrom and said first and second openings allowing rain and snow to pass through said blast shaft when said explosion relief panel is in a first position in which said explosion relief panel is adapted to substantially cover said opening in said wall, said second opening being substantially covered when said explosion relief panel is moved into a second position, said explosion relief panel is adapted to be forced away from said opening in said wall into said second position when said explosion occurs; and said first opening is disposed at a top of said blast shaft.

11. The blast shaft of claim 10, wherein said second opening is formed in a flange that is adapted to be angularly disposed from said wall.

12. A building having a wall including an opening, said building having an explosion relief system comprising an explosion relief panel for substantially covering said opening in said wall and a blast shaft mounted adjacent to said explosion relief panel, said blast shaft including a first opening and a second opening, said first opening adapted to permit at least a portion of a force of an explosion to escape therefrom and said first and second openings allowing rain and snow to pass through said blast shaft when said explosion relief panel substantially covers said opening in said wall, said second opening being substantially covered when said explosion relief panel is forced away from said opening in said wall said explosion relief panel is adapted to be forced away from said opening in said wall when said explosion occurs.

13. The building of claim 12, wherein said explosion relief panel is hingedly secured to said wall.

14. The building of claim 12, including a drop down shutter that covers said wall opening during a fire inside said building.

15. The building of claim 12, including a security alarm system.

16. The building of claim 12, wherein said building is adapted to contain hazardous materials.

17. The building of claim 12, wherein said building is made of steel.

18.The building of claim 12, including a screen for covering said wall opening to resist intruder entry and to resist objects from being propelled out of said wall opening when said explosion occurs.

19. A building having a wall including an opening, said building having an explosion relief system comprising an explosion relief panel for substantially covering said opening in said wall and a blast shaft mounted adjacent to said explosion relief panel, said blast shaft including a first opening and a second opening, said first opening adapted to permit at least a portion of a force of an explosion to escape therefrom and said first and second openings allowing rain and snow to pass through said blast shaft when said explosion relief panel substantially covers said opening in said wall, said second opening being substantially covered when said explosion relief panel is forced away from said opening in said wall said explosion relief panel is adapted to be forced away from said opening in said wall when said explosion occurs; and said first opening is disposed at a top of said blast shaft.

20. The building of claim 19, wherein said second opening is formed in a flange that is angularly disposed from said wall.

* * * * *

UNITED STATES PATENT AND TRADEMARK OFFICE

CERTIFICATE OF CORRECTION

PATENT NO. : 6,223,473 B1
DATED : May 1, 2001
INVENTOR(S) : Frederick W. Romig

It is certified that error appears in the above-identified patent and that said Letters Patent is hereby corrected as shown below:

Title page,
Item [57], ABSTRACT,
Lines 12-14, "A blast shaft substantially as described above and a building including the explosion relief system described above are also provided" should be deleted.

Column 2,
Line 2, "7" should be -- 6 --.
Line 2, delete "only".
Line 40, "blunt" should be -- blast --.
Line 67, after "an" the period "." should be deleted.

Column 3,
Line 32, after "art" a period -- . -- should be inserted.

Column 4,
Line 26, "is" should be -- in --.
Line 26, "whichsaid" should be -- which said --.
Line 27, "releif" should read -- relief --.
Lines 28 and 29, delete "is in a first position in which said explosion relief panel is adapted to".

Column 6,
Line 20, "wall" should be -- wall, --.

Signed and Sealed this

Eighth Day of October, 2002

*Attest:*

*Attesting Officer*

JAMES E. ROGAN
*Director of the United States Patent and Trademark Office*